US006305208B1

(12) United States Patent
Zimmer

(10) Patent No.: US 6,305,208 B1
(45) Date of Patent: Oct. 23, 2001

(54) EDGING DEVICE

(75) Inventor: Erich Zimmer, Wadern (DE)

(73) Assignee: Thyssen Krupp Technologies AG

( * ) Notice: Subject to any disclaimer, the term of this patent is extended or adjusted under 35 U.S.C. 154(b) by 0 days.

(21) Appl. No.: 09/600,304

(22) PCT Filed: Jan. 9, 1999

(86) PCT No.: PCT/EP99/00088

§ 371 Date: Jul. 13, 2000

§ 102(e) Date: Jul. 13, 2000

(87) PCT Pub. No.: WO99/36203

PCT Pub. Date: Jul. 22, 1999

(30) Foreign Application Priority Data

Jan. 16, 1998 (DE) ..... 198 01 561

(51) Int. Cl.[7] ..... B21D 5/01

(52) U.S. Cl. ..... 72/323; 72/319; 29/243.58

(58) Field of Search ..... 72/312, 314, 315, 72/323, 322, 387, 386, 319; 29/243.5, 243.58, 243.57

(56) References Cited

U.S. PATENT DOCUMENTS 2,233,937 * 3/1941 Hexdall ..... 29/243.5
4,072,118 * 2/1978 Schultheiss ..... 29/243.5
5,150,508 9/1992 St. Denis ..... 29/243.5
5,454,261 10/1995 Campian ..... 72/323
6,182,492 * 2/2001 Raffin ..... 27/323

FOREIGN PATENT DOCUMENTS 43 30 683 A 3/1995 (DE) .
1 302 477 A 12/1962 (FR) .
1 445 675 A 10/1966 (FR) .
2-15830 * 1/1990 (JP) ..... 72/315

* cited by examiner

*Primary Examiner*—Daniel C. Crane
(74) *Attorney, Agent, or Firm*—McGlew and Tutle, P.C.

(57) ABSTRACT

An edging device or hemming device is disclosed with a machine frame (1), an edging bed (2) which is positioned inside said frame where it is raised and lowered with an edging lift and/or a displacement lift. A plurality of edging jaws are provided, which can be moved into the working area of the edging bed (2). Drive mechanisms are provided for the edging bed (2) and the edging jaws (3). The drive mechanisms for the edging lift and the displacement lift are configured as electromechanical drive mechanisms (7) which move the edging bed (2) using driven eccentric cams (12) or cranks. This simplifies the control of the drive mechanisms and reduces the masses of the structural parts being moved.

20 Claims, 4 Drawing Sheets

EDGING DEVICE

This application is a 371 of PCT/EP99/00088, filed Jan. 9, 1999.

FIELD OF THE INVENTION

The present invention pertains to an edging device or hemming device with a machine frame, with a hemming bed arranged therein such that it can be raised and lowered with a hemming stroke and/or a displacing stroke, with a plurality of hemming jaws that can be moved into the working range of the hemming bed and with drives for the hemming bed and the hemming jaws.

BACKGROUND OF THE INVENTION

In a prior-art hemming device (U.S. Pat. No. 5,150,508), all drives consist of hydraulic cylinders. Since a plurality of hydraulic cylinders, which must all be actuated simultaneously and uniformly in terms of their stroke and their dynamic effect, are provided not only for the hemming stroke but also for the displacing stroke, the control of these drives can be problematic. To keep the number of the respective groups of hydraulic cylinders low and to guarantee, at the same time, a reliable support of these hydraulic cylinders, the components involved in this, especially the moving components, must have relatively large masses.

SUMMARY AND OBJECTS OF THE INVENTION

The object of the present invention is to simplify the control and to reduce the masses of the moving components by the use of other drives in hemming or edging devices.

This object is accomplished by the hemming bed or edging bed having an electromechanical drive for the hemming stroke, which acts on the hemming bed via driven cams or cranks. The necessary angular position of the cams or cranks can be controlled with simple means via the electromechanical drive. The cams or cranks can be accommodated in a space-saving manner and their support requires less effort, so that the masses of the moving components can also be reduced. This also applies to a preferred embodiment of the present invention, in which the cams or cranks of the hemming stroke drive act on an intermediate plate, wherein another electromechanical drive with driven cams or cranks, which are arranged between the intermediate plate and the hemming bed, is used for the displacing stroke. The intermediate plate is preferably guided on the machine frame.

The drives preferably have a transmission each with two outputs for shafts rotating in opposite directions, which carry the cams or cranks. Lateral forces, which occur during the rotation of the shaft and of the cams or cranks arranged thereon, are absorbed by the bearings of the shaft over a short distance during the movement of the shafts in opposite directions. Since considerable forces are transmitted by the cams or cranks, a design in which the shafts are mounted on the machine frame and on the intermediate plate on both sides of their cams or cranks is recommended. In addition, the cams or cranks may be mounted on associated connecting rods, whose other ends are arranged on the hemming bed or on the intermediate plate via bearings. This design also makes it possible to have greater distances between the moving components.

The design in which the cams or cranks for the hemming stroke, on the one hand, and those of the displacing stroke, on the other hand, are arranged vertically one on top of another is of particular significance, because the forces in the intermediate plate are now avoided.

The drive of a holding-down device movable up and down in the machine frame may have a braked gear motor with a driven shaft, on which pinions are arranged, which act on toothed racks which are rigid parts of the frame. The movement of the holding-down device can thus also be controlled in a simple manner.

According to the present invention, the hemming jaws are mounted pivotably on the machine frame and are able to be pivoted with pneumatic cylinders. This makes it possible to arrange the drag bearings of the hemming jaws favorably with respect to the hemming forces to be expected such that the hemming jaws will stabilize themselves during hemming.

On the whole, the use of hydraulic fluid can thus be eliminated in the hemming device according to the present invention The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
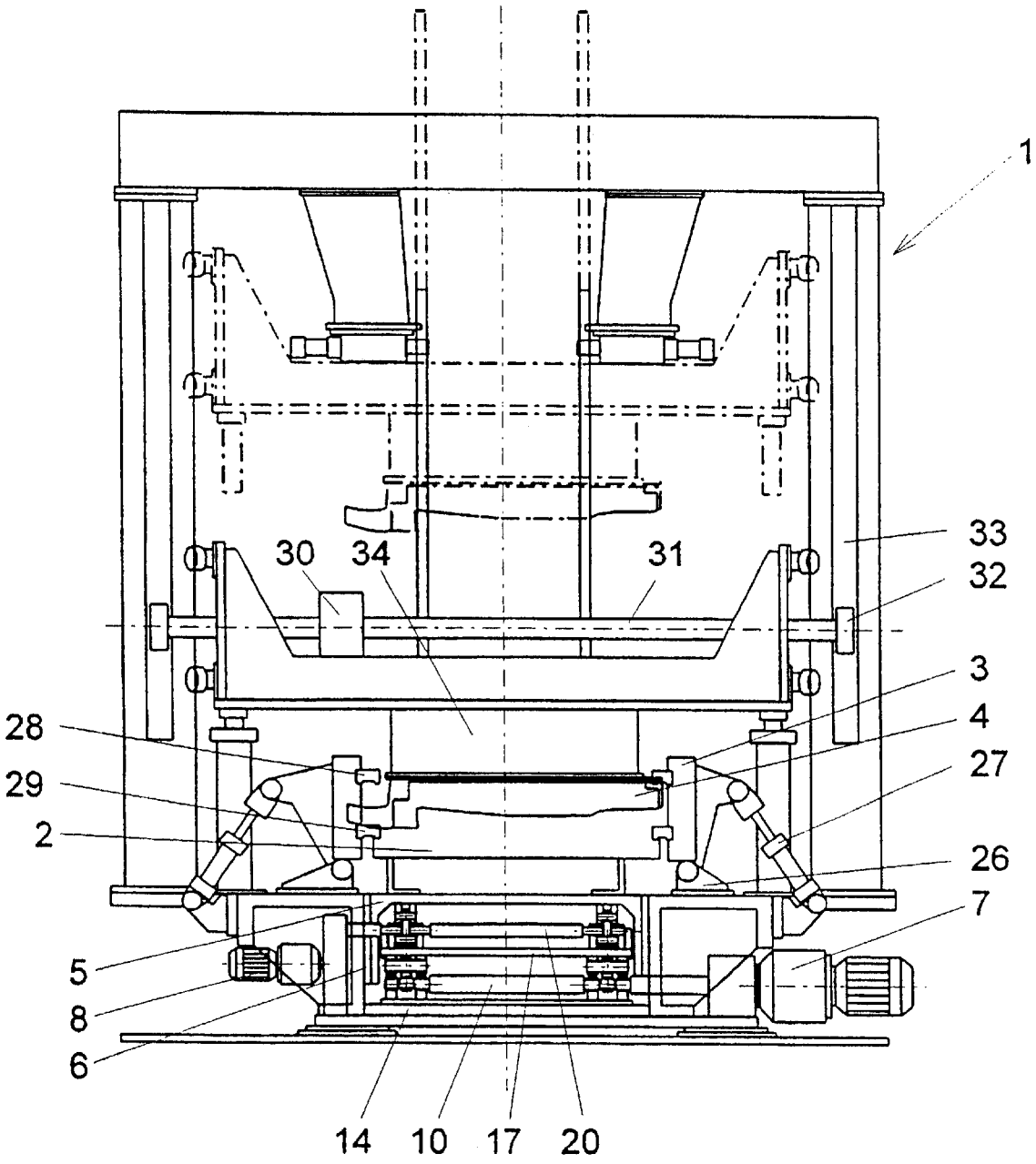
FIG. 1 is a schematic side view showing a hemming device.
Figure 2:
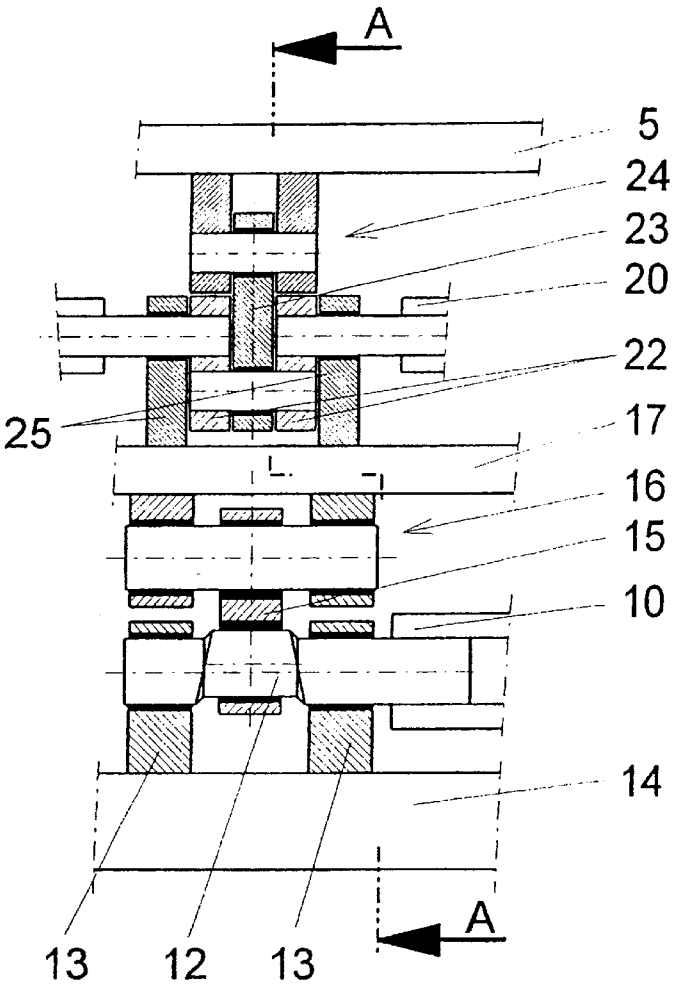
FIG. 2 is a detailed view of the subject according to FIG. 1 on an enlarged scale.
Figure 3:
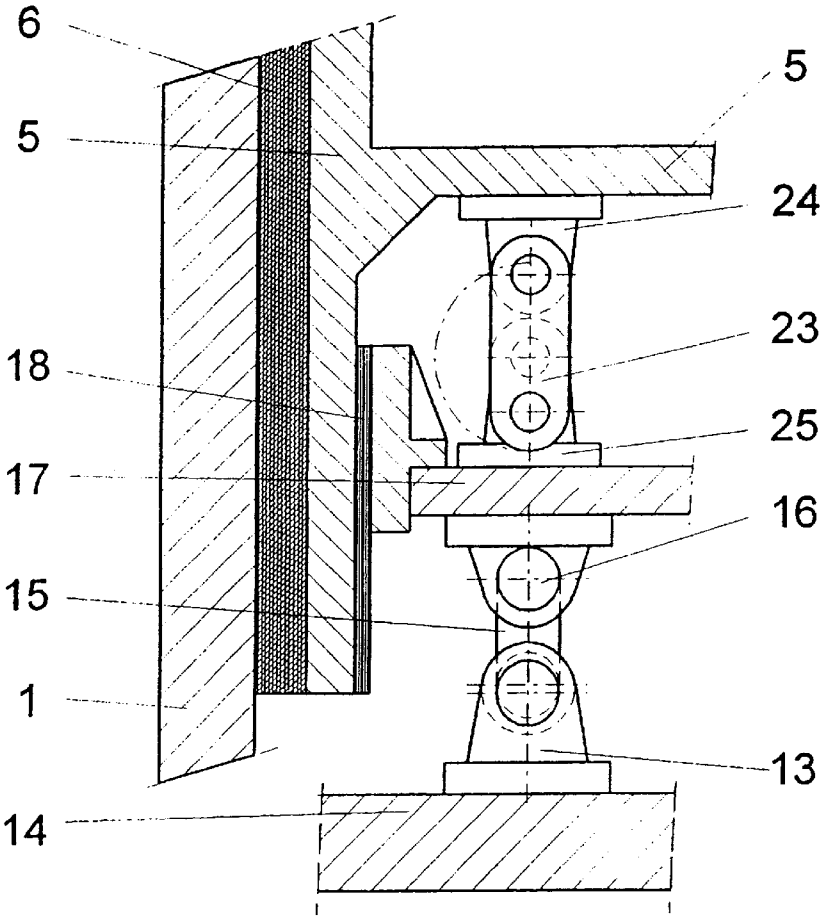
FIG. 3 is a sectional view taken through along line A—A through the subject according to FIG. 2.
Figure 4:
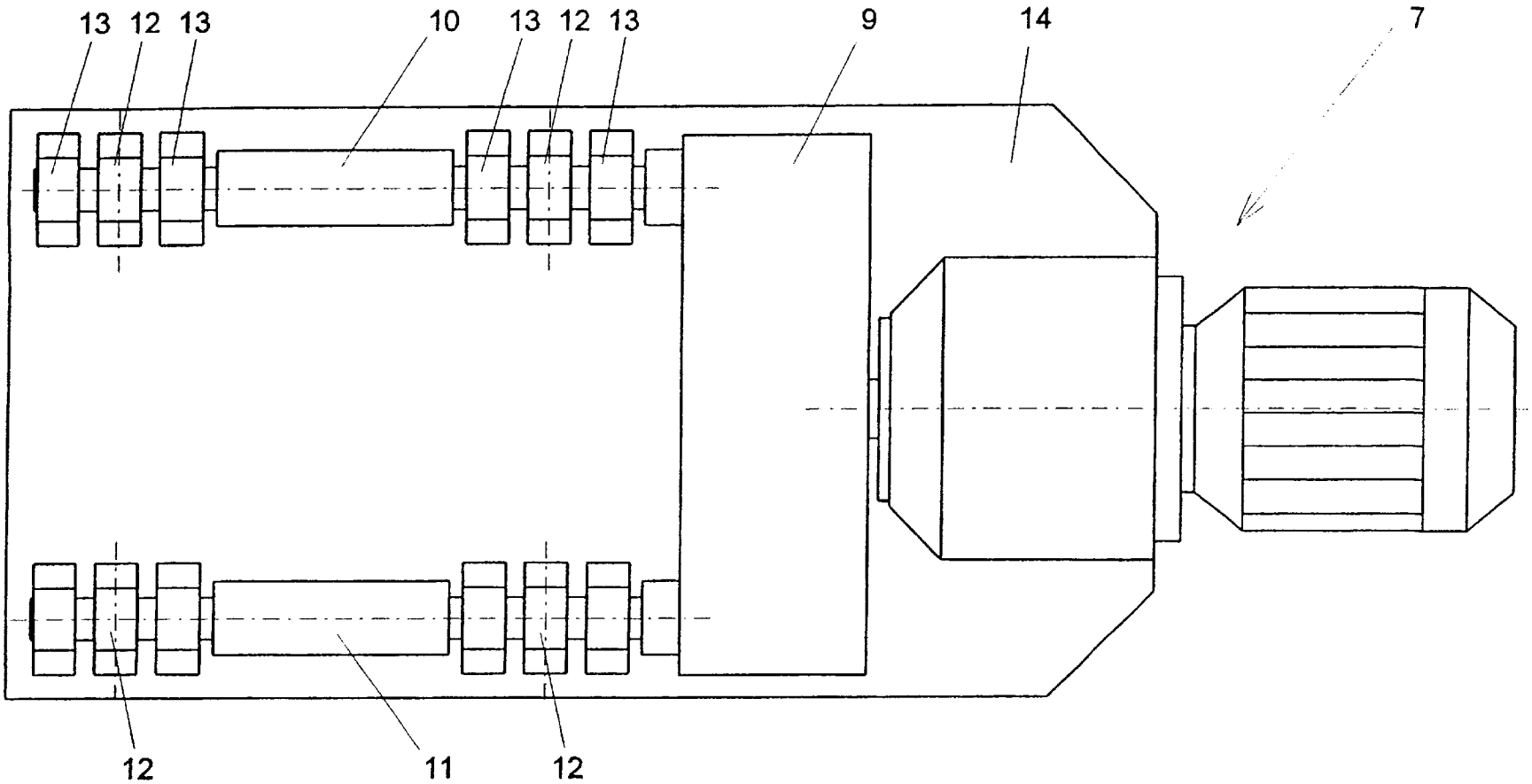
FIG. 4 is a schematic top view of a hemming stroke drive.
Figure 5:
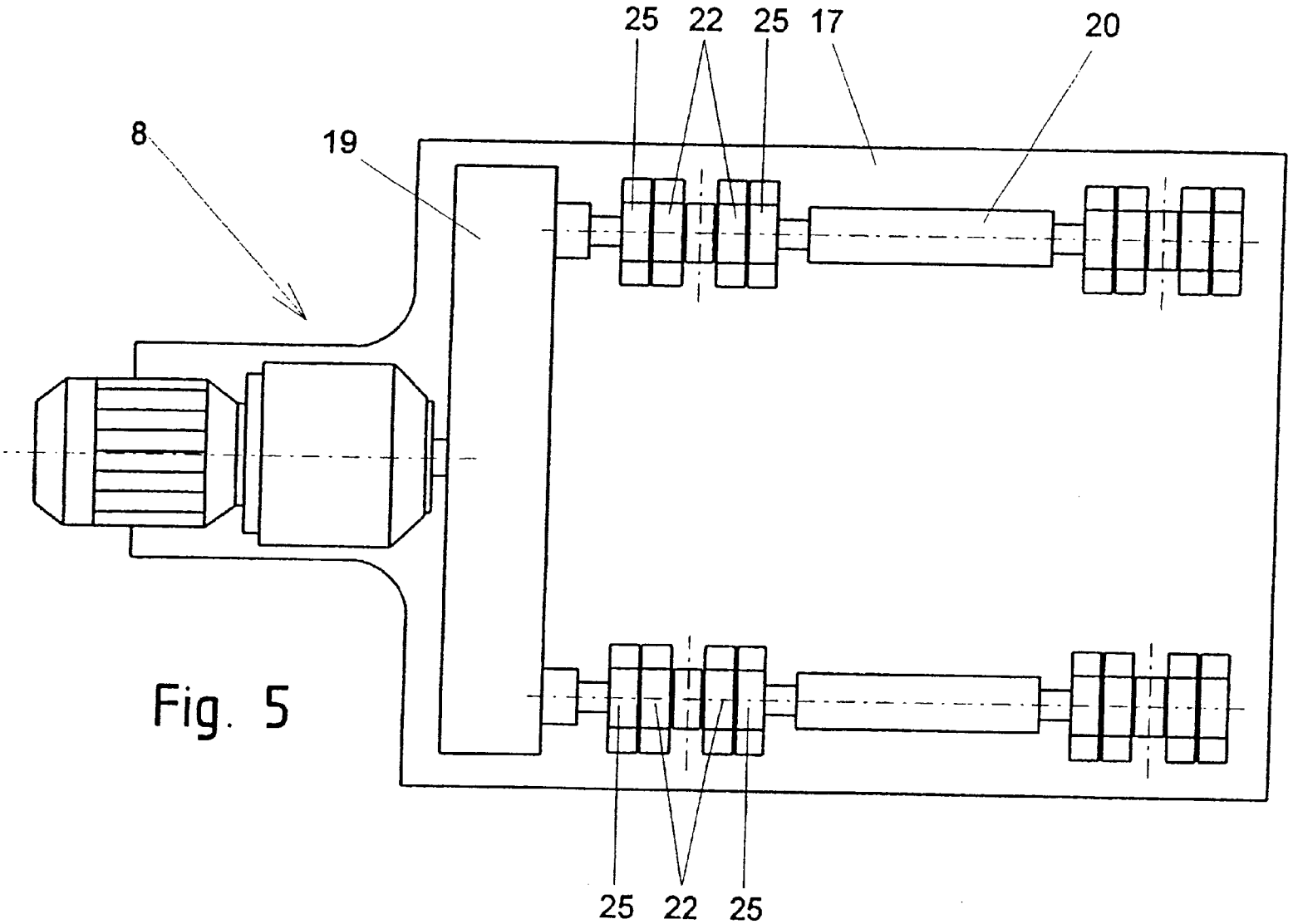
FIG. 5 is a schematic top view of a displacing stroke drive.

Referring to the drawings in particular, a machine frame 1, a hemming bed 2 arranged on it in such a way that it can be raised and lowered with a hemming stroke and a displacing stroke, a plurality of hemming jaws 3 that can be moved into the working range of the hemming bed 2, a holding-down device 4 that can be moved up and down in the machine frame 1, two-or three-stage electromechanical drives for the hemming bed 2 as well as drives for the hemming jaws 3 and for the holding-down device 4 belong to the hemming device shown.

The hemming bed 2 is fastened to a slide 5, which is guided in guides 6 of the machine frame 1. The slide 5 is box-type component, which is open at the bottom and in which a drive 7 for the hemming stroke and a drive 8 for the displacing stroke are accommodated.

A gear case 9 with two outputs for shafts 10, 11 driven in opposite directions, which carry two cams 12 each arranged at mutually spaced locations from one another in the embodiment shown, belongs to the drive 7 for the hemming stroke. On both sides of the cams 12, each shaft 10 and 11 is mounted in bearings 13, which are arranged on a base plate 14 of the machine frame 1. The cams 12 are mounted in connecting rods 15, whose other ends are mounted at 16 on the underside of an intermediate plate 17. The intermediate plate 17 is guided vertically in guides 18 inside the slide 5.

The drive 8 for the displacing stroke likewise has a gear case 19 with two outputs for shafts 20, 21 driven in opposite directions, which carry cranks 22 arranged at mutually spaced locations from one another, from which connecting rods 23 exit, which are mounted on the underside of the slide 5 at 24. The shafts 20, 21 are mounted in bearings 25 on the intermediate plate 17 on both sides of their cranks 22.

The hemming jaws 3 are mounted in drag bearings 26 on the machine frame 1, so that they are pivoted into the working range of the hemming bed 2 or out of that range by means of pneumatic cylinders 27 acting as drives. Each hemming jaw 3 has a prehemming tool 28 and a finishing hemming tool 29 arranged at a spaced location therefrom.

A braking gear motor 30, whose driven shaft 31 has end-side pinions 32, which engage toothed racks 33 fastened to the machine frame 1, is located on the holding-down device 4 guided on the machine frame 1 in the known manner. By actuating the braking gear motor 30, the holding-down device 4 can be moved up and down in a controlled manner. FIG. 1 shows the lower position of the holding-down device 4 which is indicated by solid lines and the upper position of the holding-down device 4 which is indicated by dash-dotted lines.

The hemming device shown operates as follows: With the holding-down device 4 raised and with the hemming bed 2 lowered, a workpiece to be processed is placed on the hemming bed 2. The holding-down device 4 is then lowered onto the workpiece, using a pneumatic spring 34 of the holding-down device 4 to press on the components and to compensate the displacing stroke. The drive 8 for the displacing stroke is then actuated, as a result of which the hemming bed is moved vertically upward by about 200 mm. The hemming jaws 3 are then pivoted into the working range of the hemming bed, so that the prehemming tools 28 are above the edges of the workpiece to be hemmed. By actuating the drive 7 for the hemming stroke, the hemming bed with the tool is now moved against the prehemming tools 28 and the prehemming takes place. The hemming jaws 3 are then pivoted away from the working range of the hemming bed. The drives 7 and 8 are actuated, so that the hemming bed 2 with the tool fixed on it by the holding-down device 4 is moved downward. The hemming jaws 3 are again pivoted into the working range, so that the finishing hemming tools 29 are again in the working range of the hemming bed 2. By actuating the drive 7 for the hemming stroke, the hemming bed 2 is moved vertically upward by about 20 mm, so that the workpiece is subjected to finishing hemming under the action of the finishing hemming tools 29. The holding-down device 4 is subsequently moved upward, so that the workpiece can be removed from the hemming bed.

While specific embodiments of the invention have been shown and described in detail to illustrate the application of the principles of the invention, it will be understood that the invention may be embodied otherwise without departing from such principles.

What is claimed is:

1. A hemming device, comprising:

a machine frame;

a hemming bed arranged in said machine frame so as to be raised and lowered with a hemming stroke and/or a displacing stroke;

a plurality of hemming jaws that can be moved into a working range of the hemming bed;

a hemming bed drive connected to said hemming bed, said hemming bed drive including an electromechanical drive mechanisim for producing a hemming stroke and driven cams or driven cranks, said electromechanical drive mechanisim acting on said hemming bed via said driven cams or driven cranks; and a hemming jaw drive connected to said hemming jaws.

2. A hemming device in accordance with claim 1, further comprising an intermediate plate, wherein said cams or cranks of said hemming bed drive act on said intermediate plate and said hemming jaw drive is another electromechanical drive with driven cams or driven cranks arranged between said intermediate plate and said hemming bed, said another electromechanical drive being provided for the displacing stroke.

3. A hemming device in accordance with claim 2, wherein said intermediate plate is guided on said machine frame.

4. A hemming device in accordance with claim 2, wherein said hemming bed drive and said hemming jaw drive carry a respective transmission each with two outputs for respective first and second shafts, wherein each of said first and second shafts rotate in opposite directions and carry said respective driven cams or said driven cranks.

5. A hemming device in accordance with claim 1, wherein said hemming jaw drive is another electromechanical drive with driven cams or driven cranks, said another electromechanical drive being provided for the displacing stroke and wherein said hemming bed drive and said hemming jaw drive carry a respective transmission each with two outputs for respective first and second shafts, wherein each said first shaft of each drive rotates in opposite direction to each second shaft of each drive and each shaft respectively carries one of said driven cams or said driven cranks.

6. A hemming device in accordance with claim 5, further comprising an intermediate plate, wherein said shafts are mounted on said machine frame and on said intermediate plate on both sides of the respective cams or said cranks.

7. A hemming device in accordance with claim 5, further comprising connecting rods mounted to said cams or said cranks with ends of the connecting rods acting on the intermediate plate or on the hemming bed via said bearings.

8. A hemming device in accordance with claim 5, wherein said cams or said cranks for the hemming stroke, on the one hand, and for the displacing stroke, on the other hand, are arranged vertically one on top of another.

9. A hemming device in accordance with claim 1, further comprising a holding down device drive with a braked gear motor with a driven shaft, pinions arranged on the driven shaft, toothed racks that are rigid parts of said machine frame, one of said pinions engaging one of said toothed racks and the other of said pinions engaging the other of said toothed racks wherein said holding-down device can be moved up and down in said machine frame.

10. A hemming device in accordance with claim 1, further comprising pneumatic cylinders wherein said hemming jaws are mounted pivotably on said machine frame and can be pivoted with said pneumatic cylinders.

11. An edging device, comprising:

a machine frame;

an edging bed arranged in said machine frame so as to be raised and lowered with an edging stroke and a displacing stroke;

a plurality of edging jaws that can be moved into a working range of the edging bed;

an edging bed drive connected to said edging bed, said edging bed drive including an electromechanical drive mechanisim for producing an edging stroke and driven cams or driven cranks, said electromechanical drive mechanisim acting on said edging bed via said driven cams or driven cranks; and an edging jaw drive connected to said edging jaws for moving the edging jaws into and out of the working range of the edging bed.

12. An edging device in accordance with claim 11, further comprising an intermediate plate, wherein said cams or cranks of said edging stroke drive act on said intermediate plate and said edging jaw drive is another electromechanical drive with driven cams or driven cranks arranged between said intermediate plate and said edging bed, said another electromechanical drive being provided for the displacing stroke.

13. An edging device in accordance with claim 12, wherein said intermediate plate is guided on said machine frame.

14. An edging device in accordance with claim 11, wherein said edging jaw drive is another electromechanical drive with driven cams or driven cranks, said another electromechanical drive being provided for the displacing stroke and wherein said edging bed drive includes an edging drive transmission with a first output shaft and a second output shaft, wherein said first output shaft rotates in opposite direction to said second output shaft, said first output shaft and said second output shaft respectively carrying one of said driven cams or said driven cranks, said edging jaw drive including an edging drive transmission with a first edging jaw output shaft and a second edging jaw output shaft, wherein said first edging jaw output shaft rotates in opposite direction to said second edging jaw output shaft, said first edging jaw output shaft and said second edging jaw output shaft respectively carrying one of said driven cams or said driven cranks.

15. An edging device in accordance with claim 14, further comprising an intermediate plate, wherein said shafts are mounted on said machine frame and on said intermediate plate on both sides of the respective said cams or said cranks.

16. An edging device in accordance with claim 14, further comprising an intermediate plate and connecting rods mounted to said cams or said cranks with ends of the connecting rods acting on said intermediate plate or on the edging bed via said bearings.

17. An edging device in accordance with claim 14, wherein said cams or said cranks for the edging stroke, on the one hand, and for the displacing stroke, on the other hand, are arranged vertically one on top of another.

18. An edging device in accordance with claim 11, further comprising a holding down device and a holding down device drive with a braked gear motor with a driven shaft, pinions arranged on the driven shaft, toothed racks that are rigid parts of said machine frame, one of said pinions engaging one of said toothed racks and the other of said pinions engaging the other of said toothed racks wherein said holding-down device can be moved up and down in said machine frame.

19. An edging device in accordance with claim 11, further comprising pneumatic cylinders wherein said edging jaws are mounted pivotably on said machine frame and can be pivoted with said pneumatic cylinders.

20. An metal edge treatment device, comprising:

a machine frame;

a hemming bed arranged in said machine frame so as to be raised and lowered with a hemming stroke and a displacing stroke;

a plurality of hemming jaws that can be moved into a working range of the hemming bed;

pneumatic cylinders connected to said hemming jaws wherein said hemming jaws are mounted pivotably on said machine frame and can be pivoted with said pneumatic cylinders;

a hemming bed drive connected to said hemming bed, said hemming bed drive including an electromechanical drive mechanisim for producing a hemming stroke and driven cams or driven cranks, said electromechanical drive mechanisim acting on said hemming bed via said driven cams or driven cranks;

a hemming jaw drive connected to said hemming jaws for moving the hemming jaws into and out of the working range of the hemming bed, said hemming jaw drive being another electromechanical drive with driven cams or driven cranks, said another electromechanical drive being provided for the displacing stroke.

* * * * *